United States Patent [19]

Messé et al.

[11] Patent Number: 4,522,094

[45] Date of Patent: Jun. 11, 1985

[54] AUTOMATIC LAMINATION CUTTING MACHINE FOR ELECTRIC SHUNT INDUCTION WINDING

[75] Inventors: Gérard Messé, Maule; Michel Faure, Houilles; Marcel Ducombs, Rueil-Malmaison, all of France

[73] Assignee: Alsthom-Atlantique, Paris, France

[21] Appl. No.: 586,464

[22] Filed: Mar. 5, 1984

Related U.S. Application Data

[62] Division of Ser. No. 262,878, May 12, 1981, Pat. No. 4,453,150.

[30] Foreign Application Priority Data

May 12, 1980 [FR] France ..... 80 10574

[51] Int. Cl.[3] ..... B26D 7/32

[52] U.S. Cl. ..... 83/92; 83/373; 83/391; 83/467 R

[58] Field of Search ..... 83/161, 167, 88, 90–94, 83/157, 373, 391, 467 R, 467 A, 468; 29/609; 336/234

[56] References Cited

U.S. PATENT DOCUMENTS 3,220,291 11/1965 Olsen et al. ..... 83/467 X

FOREIGN PATENT DOCUMENTS 512381 4/1955 Canada ..... 29/609

*Primary Examiner*—James M. Meister

*Attorney, Agent, or Firm*—Sughrue, Mion, Zinn, Macpeak, and Seas

[57] ABSTRACT

An automatic sheet metal cutting machine has a continuous supply of metal strips in adjustable lengths, at will. A reciprocating cutter cuts laminations from the metal strip and a receiver receives the laminations. The receiver includes a swiveling plate movable through an angle $\alpha$ at will about a pin perpendicular to the direction motion of the laminations. The receiver is lowered and moved downstream relative to the direction of motion of the laminations received thereby.

1 Claim, 7 Drawing Figures

AUTOMATIC LAMINATION CUTTING MACHINE FOR ELECTRIC SHUNT INDUCTION WINDING

This is a division of application Ser. No. 262,878, filed May 12, 1981 now U.S. Pat. No. 4,453,150.

The present invention relates to a shunt inductance winding.

BACKGROUND TO THE INVENTION

It is known to use shunt inductance windings to increase the stability of the grid by compensating the capacititive reactance of long electricity power transport lines, which are generally high-tension lines.

There are two types of shunt inductance winding: the magnetic barrel type without a core and the iron core type with air gaps. This second type of inductance winding is being used more and more because of the design possibilities it offers users due to its saturation characteristics. The core of such a winding is then constituted by a vertical stack of iron disks separated by air gaps. In a known embodiment, the metal laminations of each iron disk are disposed substantially radially so that, when observed from above, the disks have central holes. The disks are built up from sector-shaped portions. One such portion is constituted by juxtaposing bundles of metal laminations of progressively increasing length per bundle and with the laminations occupying vertical planes. A portion generally includes six to eight bundles in a stepped configuration. In this known disposition, the laminations are so arranged that the direction in which the metal passed through the rolling mill is axial, parallel to the direction of the main magnetic field.

In such a disposition, it is difficult to obtain a filling coefficient of more than 0.8 under acceptable conditions. Then, because of the constraint concerning the alignment of the direction in which the metal lamination passed through the rolling mill with the main magnetic field, it is necessary to have as many rolls of magnetic metal sheet of different widths available as there are bundles of metal laminations of different lengths in a sector-shaped portion. Alternatively only one roll is used whose width corresponds to the length of the longest bundle of metal laminations in a sector-shaped portion but then this makes extra cutting necessary in a perpendicular direction for the shorter bundles, and hence more work and numerous scraps of sheet metal.

The present invention aims to improve the filling coefficient, to facilitate industrial manufacture of the cores, and to minimize the total iron losses due to the main magnetic flux and to the extra losses due to the interference fringes between successive sections.

SUMMARY OF THE INVENTION

The present invention provides an electric shunt induction winding for an electricity power transport line, which winding has a magnetic core with an electric coil and a magnetic barrel winding round it to close the magnetic circuit, said magnetic core comprising a vertical stack of iron disks separated from one another by air gaps, each disk having a central hole and being constituted by juxtaposing a plurality of sector-shaped portions, each sector-shaped portion comprising a succession of magnetic laminations situated in vertical planes which are parallel to the axis of the electric winding, wherein each sector-shaped portion is formed by a first bundle of laminations all of identical length and by a second bundle of laminations of regularly decreasing lengths from one sheet to the next and wherein the direction in which the laminations are rolled in the mill is perpendicular to the axis of the winding.

Preferably said first bundle of laminations is divided into two parts which sandwich said second bundle of laminations.

The industrial manufacture of such sector-shaped portions of disks is then greatly facilitated since only one roll of metal sheet is required whose width corresponds to the thickness of the disks, even if it needs splitting lengthwise to obtain the proper width. A programmed automatic machine can then easily cut the metal sheets to the required length and there are no scraps.

The filling coefficient in such a disposition is at least 0.94. This is better than in any known case and the total magnetic losses which are due to the losses of the main leakage flux and to interference fringe losses between successive disks are much the same overall. Thus, although losses due to the main flux in the disposition in accordance with the invention are about two and a half times greater than those in the above-mentioned known disposition (because the metal laminations have their mill rolling axis perpendicular to the axis of the winding), losses due to interference fringes are negligible in the disposition in accordance with the invention. Total losses are therefore not increased.

Thus, the invention is advantageous even in the case when all the crystals of the laminations are, in fact, aligned with the rolling direction and are therefore at right angles to the normally preferred direction for use of magnetic laminations.

The invention also provides an automatic sheet metal cutting machine which includes means for continuously supplying the machine with metal strip in adjustable lengths and at will, cutting means and means for receiving the laminations cut from the metal strip, wherein the means for receiving the laminations include a swivelling plate which can move through an angle of $\alpha$ at will about a pin perpendicular to the direction of motion of the laminations, means for lowering the receiving means and means for movinng the receiving means downstream relative to the direction of motion of the laminations.

BRIEF DESCRIPTION OF THE DRAWINGS

The invention will be better understood from the description of an embodiment of the invention given hereinafter with reference to the accompanying drawings in which.

DESCRIPTION OF PREFERRED EMBODIMENT

Figure 1:
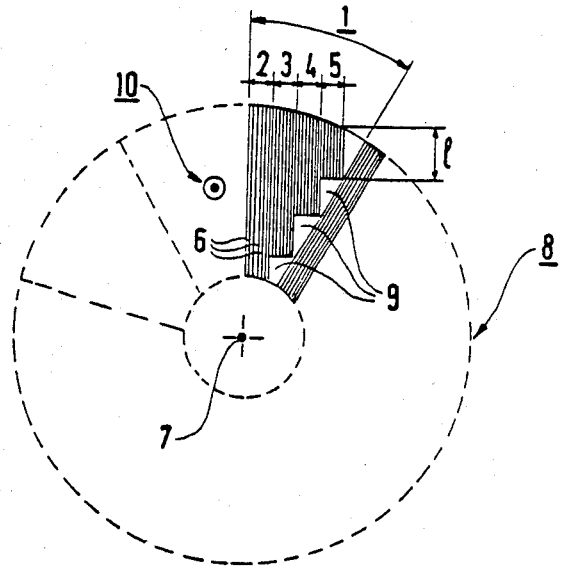
FIG.1 PRIOR ART
FIG. 1 is a plan view of a prior art sector-shaped portion of a magnetic core disk from a shunt induction winding.

FIG. 1 shows a sector-shaped portion of a prior magnetic core disk from a shunt induction winding. In this figure, a sector-shaped portion 1 is constituted by juxtaposing a plurality of bundles 2, 3, 4, 5, of metal laminations 6. In the Figure, there are four such bundles per sector-shaped portion.

In each bundle, the laminations are of the same length, but this length decreases from bundle 2 to bundle 5. The laminations 6 are placed vertically, i.e. in planes parallel to the axis 7 of the winding which is also the axis of the disk 8. This sector-shaped portion 1 thus has a stepped configuration and assembling a plurality of such sector-shaped portions 1 to form the complete disk 8 leaves empty spaces such that the filling coefficient is about 0.8 at best. These empty spaces are then filled with polymerisable resin.

Figure 2:
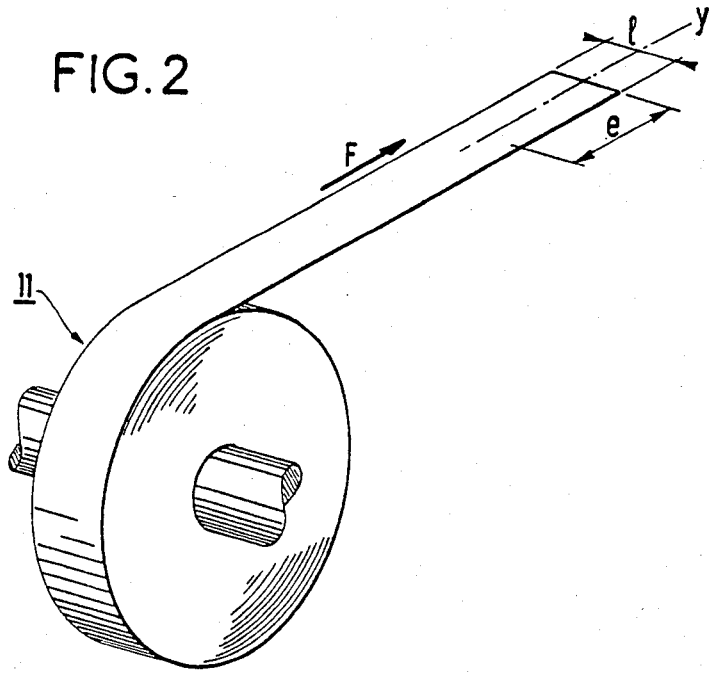
FIG. 2 is a perspective view which shows a roll of magnetic metal sheet from which laminations are cut.

In this known dispositions, the laminations are disposed so that the direction in which the lamination forming strip was rolled in the mill is parallel to the axis 7 of the winding as symbolically shown by the sign referenced 10. Now, the laminations are cut out from rolls of strip such as roll 11 in FIG. 2 which is rolled in the mill in the direction shown by arrow F in FIG. 2. It is therefore necessary for each bundle 2, 3, 4 or 5 to use a roll 11 whose width l corresponds to the length l of the bundle in question. The metal sheets are then cut along a length e equal to the thickness e (FIG. 6) of the disk 8. If only one roll of single width is used, a roll whose width corresponds to the length of the longest bundle must be taken: this is bundle 2 in FIG. 1. Then, to make the following bundles, i.e. 3, 4 and 5 it is necessary not only to cut the laminations out from the roll 11 along a length e, but also to cut then out in a perpendicular direction y so as to obtain laminations which correspond to the lengths of the bundles 3, 4 and 5. Besides the extra cutting required, in this latter solution, there are a lot of scraps. Thus, because of the orientation of the laminations 6 in the sector-shaped portions 1, it is necessary to limit the number of bundles which constitute a portion 1 since, in practice, as many rolls of different widths are required as there are bundles to a sector-shaped portion. The solution of using a roll of single width is not practical because of the scraps and because of the complication. Therefore the width of the bundles is increased so as to obtain a reasonable compromise between the number of bundles and the filling coefficient. It is obvious to the person skilled in the art to dispose the laminations in such a way that the direction of rolling in the mill is that shown by the sign referenced 10, i.e. parallel to the axis 7 of the winding, since this corresponds to the direction of the main flux in the winding.

Figure 3:
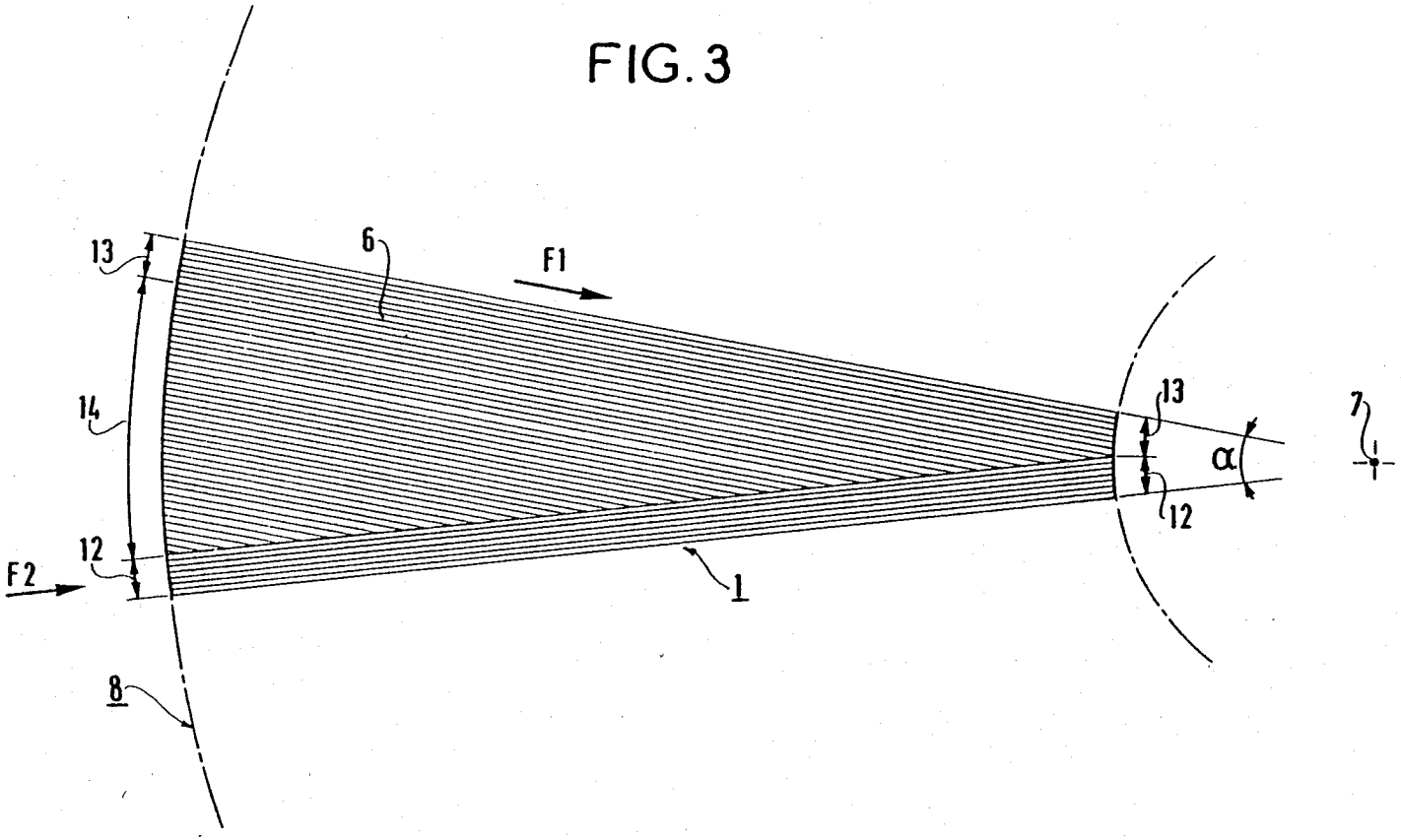
FIG. 3 is a plan view of a sector-shaped portion of a magnetic core disk from a shunt induction winding in accordance with the invention.

Precisely, as illustrated in FIG. 3, the present invention lies in disposing the laminations in such a way that the direction in which each metal sheet is rolled in the mill is perpendicular to the axis 7 of the winding, i.e. in the direction $F_1$. The lengths of the laminations can then be stepped from one lamination to the next rather than in bundles and it is only necessary to have a roll of lamination strip whose width corresponds to the constant thickness e, (see FIG. 6), of the disk 1.

The machine can be programmed to cut out laminations of the required without difficulty.

Tests have shown that although the direction in which the laminations are rolled in the mill is perpendicular to the main flux, the total losses are substantially the same due to a considerable reduction in the losses due to interference fringes between the various disks 8. Therefore, manufacture is much more simple and the filling coefficient is improved. Further, for an equal cross-section of iron, the outside diameter of the disk is smaller and therefore the masses of the core iron and the winding copper can be reduced, as can the mass of the insulators.

FIG. 3 shows a sector-shaped portion 1 of a disk 8 produced in accordance with the invention. This sector-shaped portions includes two bundles 12 and 13 of laminations 6 each of identical length. These two bundles 12 and 13 sandwich a bundle of metal sheets 14 which are all of different lengths.

Figure 4:
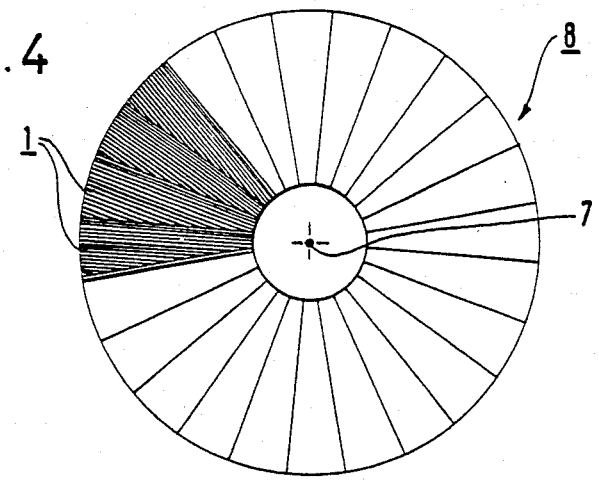
FIG. 4 is a plan view which shows the positions of the various portions in a disk.

FIG. 4 shows the juxtaposition of the various sector-shaped portions 1 in the disk 8.

Figure 5:
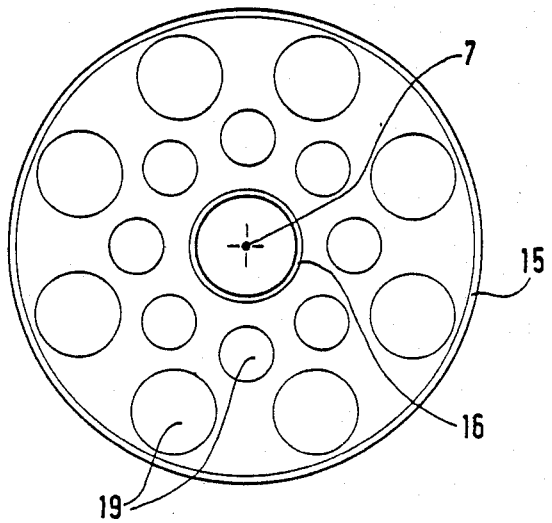
FIG. 5 is a plan view of a complete disk ready to be impregnated with resin.
Figure 6:
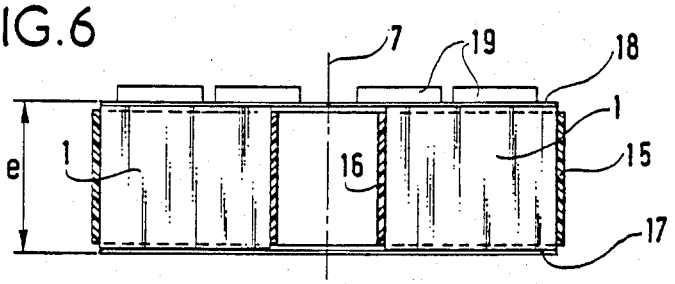
FIG. 6 is a vertical sectional view of the disk of FIG. 5.

FIGS. 5 and 6 show a complete disk ready for impregnation with resin. The laminations are supported between mechanically strong and insulating inner and outer peripheral cylinders 15 and 16 with fibre glass sheets 17 and 18 placed over the bottom and the top openings, respectively.

Separators 19 are placed on top of the disk so as to provide an air gap between one disk and the next which is installed above it. These separators are made of slate.

The assembly is then placed in an oven in which a vacuum is set up; an impregnation resin such as a polymerisable epoxy resin is then poured in drop by drop and heat treatment is carried out to ensure polymerisation.

Figure 7:
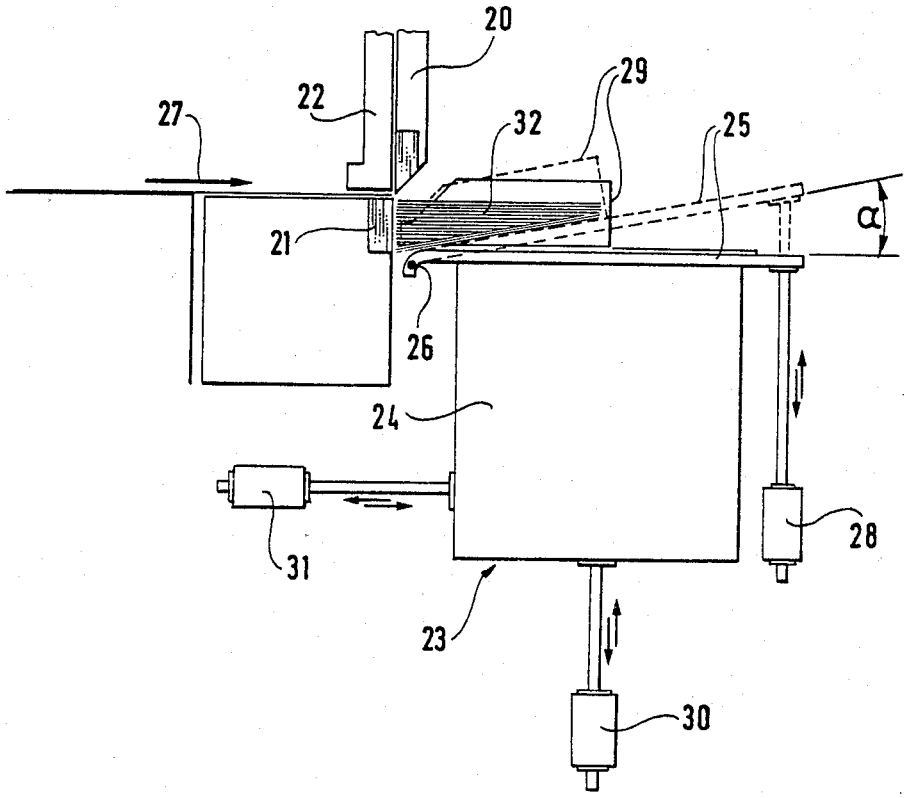
FIG. 7 is a diagrammatic illustration of a machine for cutting laminations from magnetic strip.

FIG. 7 shows a metal sheet cutting machine which includes a lamination receiver capable of forming bundles of laminations such as the bundle of laminations 1 illustrated in FIG. 3.

The machine mainly comprises three parts.

Strip metal supply means (not shown) conventionally includes a stationary stop. A moving stop is moved by a guide screw and a moving clamp moves between the two stops. The clamp grips the metal sheet at the end of its return run which is limited by the moving stop, draws it forward until the stationary stop releases the metal sheet after cutting. The distance between the stationary stop and the moving stop determines the length of metal strip cut.

Actual shearing means includes a moving blade 20, a stationary counter-blade 21 and a strip metal locking device 22.

A receiving device 23 includes a frame 24 on which there is placed a swivelling plate 25 which can be adjusted at will by means of a jack 28 through an angle $\alpha$ about a pin perpendicular to the direction of motion of the metal strip 27. The plate 25 has side plates 29 with adjustable spacing. A jack 30 effects the vertical movement of the frame 24. Thus, the drop distance of the cut strip can be kept constant. Lastly, a jack 31 effects the downstream movement of the frame 24 (towards the right in the figure) to remove the bundles of cut out laminations 32. All the movements of the plate 25, of the jacks 28, 30, 31, of the blade 20, of the means for supplying metal strip are automatic and programmed.

To form a bundle of laminations such as the sector-shaped portion 1 illustrated in FIG. 3., firstly, the plate 26 is set in the horizontal position, the angle $\alpha$ being equal to 0 and the laminations arrive in the direction of the arrow $f_2$ (FIG. 1). The laminations of the bundle 12 are cut first, then automatically, in accordance with the program, the jack 28 rotates the plate 25 about its axis 26 through an angle $\alpha$ equal to the angle $\alpha$ of the sector-shaped portion 1 and the bundle 14 of laminations is then cut and its laminations fall flat; the machine is also programmed to increase the length of each lamination step by step. The step y is, for example, 1.76 mm for laminations whose thickness g is 35 hundredths of a millimeter and whose angle $\alpha$ is 11°15′, this corresponding to thirty two sector-shaped portions 1 in a section 8. The formula for the pitch y is: $y=g/\tan \alpha$.

Without changing the angle $\alpha$, the laminations of the bundle 13 are cut to an identical length. During the whole cutting time, the jack 30 lowers the frame 24 continuously so as to make the laminations drop a constant height. Lastly, the jack 31 pushes the frame 24 towards the right and the bundle of laminations can be taken away.

We claim:

1. An automatic sheet metal cutting machine which includes means for continuously supplying the machine with metal strip in adjustable lengths and at will, cutting means and means for receiving the laminations cut from the metal strip, wherein the means for receiving the laminations include a swivelling plate which can move through an angle of $\alpha$ at will about a pin perpendicular to the direction of motion of the laminations, means for lowering the receiving means and means for moving the receiving means downstream relative to the direction of motion of the laminations.

* * * * *